United States Patent [19]

Wallace

[11] 4,393,664

[45] Jul. 19, 1983

[54] MULTIPLE DAMPER ASSEMBLY FOR REACH-IN CASES OF THE AIR DEFROST TYPE

[75] Inventor: George E. Wallace, Levittown, Pa.

[73] Assignee: Emhart Industries, Inc., Farmington, Conn.

[21] Appl. No.: 334,482

[22] Filed: Dec. 24, 1981

[51] Int. Cl.[3] ..... A47F 3/04

[52] U.S. Cl. ..... 62/256; 62/282

[58] Field of Search ..... 62/256, 255, 82, 282

[56] References Cited

U.S. PATENT DOCUMENTS

| | | | |
|---|---|---|---|
| 3,648,482 | 3/1972 | Beckwith et al. | 62/256 |
| 3,850,003 | 11/1974 | Beckwith et al. | 62/82 |
| 3,937,033 | 2/1976 | Beckwith et al. | 62/155 |
| 4,072,488 | 2/1978 | Johnston | 62/282 |
| 4,144,720 | 3/1979 | Subera et al. | 62/256 |
| 4,245,482 | 10/1981 | Abraham | 62/256 |

*Primary Examiner*—William E. Tapolcai

*Attorney, Agent, or Firm*—Frederick A. Zoda; John J. Kane; Albert Sperry

[57] ABSTRACT

A damper system, for a reach-in refrigerated display case of the air-defrosted type utilizes a single gear-reduction, reversible motor to operate between open and closed positions a multiplicity of dampers, all of which must be operated simultaneously. A radial arm on the motor shaft has a pin-and-slot connection to one damper connected to a series of other dampers pivoted about a common axis for joint opening and closing thereof. Each of the connected dampers includes cam means acting upon tongues of a second series of dampers pivoted about a common axis parallel to the axis of the first damper series. When the dampers of the first series are actuated to open position, the cams individual to the dampers of that series act to cause corresponding dampers of the second series to open simultaneously therewith. In a similar fashion, all the dampers are closed simultaneously by reason of their interconnection and cam action. The disclosed invention has particular adaptability for incorporation in refrigerated display cases in which dampers control the inflow and exhaust of ambient air used in the described type of cases for defrost purposes.

10 Claims, 8 Drawing Figures

MULTIPLE DAMPER ASSEMBLY FOR REACH-IN CASES OF THE AIR DEFROST TYPE

CROSS-REFERENCE TO RELATED APPLICATIONS

The present application is related to application Ser. No. 334,416, filed by Ronald R. Rosanio, John J. Jud, and Anthony Guaragno, titled "REACH-IN REFRIGERATED DISPLAY CASE WITH AMBIENT AIR DEFROST", filed contemporaneously herewith (now U.S. Pat. No. 4,375,155).

BACKGROUND OF THE INVENTION

1. Field of the Invention

The present invention is in the field of refrigeration generally, and in a more particular sense has reference to refrigerated display cases used in food markets. In a still more specific sense, the invention relates to cases of the air curtain type, in which air is introduced from the surrounding ambient atmosphere to flow through the evaporator coils of a case during defrost cycles. Although the invention is illustrated with specific reference to a "reach-in" case in which there is a door closing the customer access opening, it is applicable as well to upright, open front cases in which the customer access is continuously open.

2. Description of the Prior Art

In display cases of the air-defrosted type, it is common to utilize dampers for the purpose of bringing the air passages of the case into or out of communication with the ambient atmosphere. It has been proposed in many instances to provide a separate operating motor and linkage for each damper, with the several motors being part of a common electrical circuit for the purpose of effecting joint actuation of the dampers between their open and closed positions. This may result in considerable expense, both with respect to the original cost and maintenance of the several electric motors, and also in light of the extensive electrical wiring and connections needed to link all of the motors for joint operation. This expense can be quite high in many instances. For example, in many food markets an entire, elongated array or bank of cases might be installed, in end-to-end relationship, in which each case or section of a case must of necessity include an entire series of inflow dampers, and another series of exhaust dampers.

Problems arise, further, when dampers are in relatively inaccessible locations, since they are often prone to malfunction, and must of course in any event receive periodic maintenance to assure their retention in good working order.

So far as is known, the prior art has not offered as yet, solutions to the indicated problems, which solutions will result in simultaneous operation of an entire row of paired inflow and exhaust dampers, utilizing the fewest possible number of electrical motors, a simplified electrical circuit, and interconnections of a mechanically simple nature that will reduce to a minimum the time and expense required for maintenance and repair of the damper system.

The present invention seeks to overcome these deficiencies noted in the prior art, and aims to do so while still permitting all the dampers to be mounted in a fully accessible position for the purpose of facilitating inspection and normal maintenance.

SUMMARY OF THE INVENTION

Summarized briefly, the invention is especially well adapted for use in a reach-in display case of the air-defrosted type, utilizing the air defrost system disclosed and claimed in the above mentioned contemporaneously filed application. The invention can, however, also be used in open front cases as well as those in which the customer access opening is normally closed by a door, so long as the open front cases have air inflow duct means and air exhaust means in close proximity as in the mentioned, contemporaneously filed application referred to above.

In any event, the present invention includes a series of air exhaust dampers, mounted upon the top of a case and spaced longitudinally of the case, the dampers being operable between open and closed positions about a common axis. In accordance with the invention, all the dampers are interconnected by a connecting bar, so that the opening of one damper results in the opening of all the other dampers of the series, the same being true when any damper of the series is closed.

A single motor is used for the purpose of opening all of the dampers of the exhaust series, through the provision of a radial arm on the motor, which is of the reversible type. The arm acts upon one of the dampers, preferably a damper located substantially midway between the opposite ends of the entire series thereof.

Each damper of the series includes cam means projecting toward corresponding dampers of a second series. The dampers of the second series are inflow dampers, and are to be opened and closed simultaneously with those in the first, air exhaust series. By cam action, each damper of the exhaust type, when opened, acts upon an inflow damper paired therewith, so that operation of the single motor in one direction results in simultaneous opening of all inflow and exhaust dampers spaced longitudinally of a single case or section of a case. Thereafter, when the dampers of the exhaust series are lowered to closed position by reversing of the motor, the inflow dampers are left free either to gravitate to closed positions, move to closed positions by spring action, or move to their closed positions by direct interconnection of the cam surfaces provided upon each pair of inflow and exhaust dampers.

BRIEF DESCRIPTION OF THE DRAWINGS

While the invention is particularly pointed out and distinctly claimed in the concluding portions herein, a preferred embodiment is set forth in the following detailed description which may be best understood when read in connection with the accompanying drawings, in which:

DETAILED DESCRIPTION OF THE PREFERRED EMBODIMENTS

Figure 1:
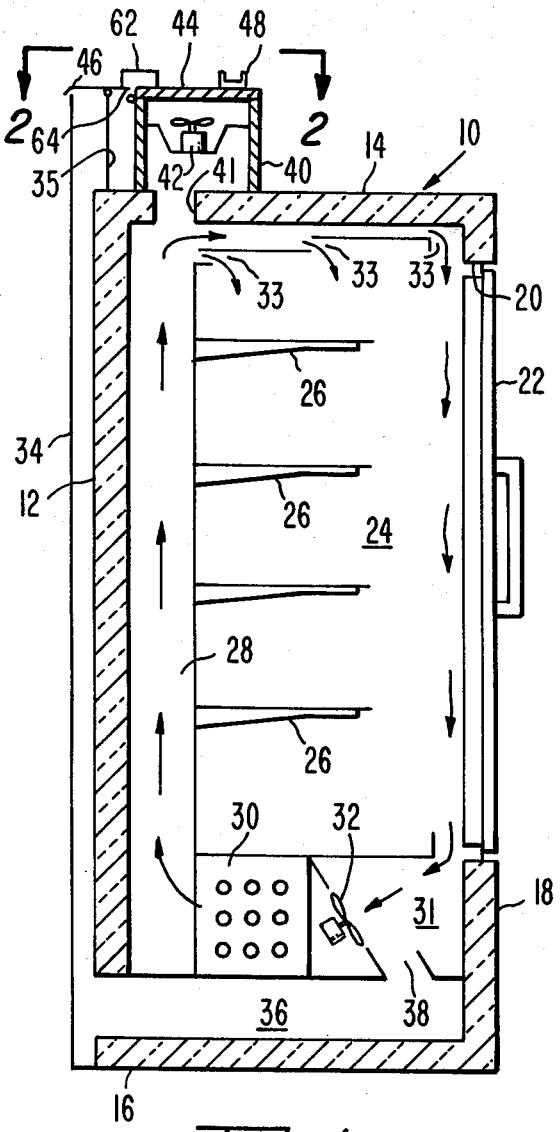
FIG. 1 is a vertical sectional view through a reach-in case of the air-defrosted type in which paired inflow and exhaust dampers are shown in closed position, taken substantially on line 1—1 of FIG. 2.
Figure 2:
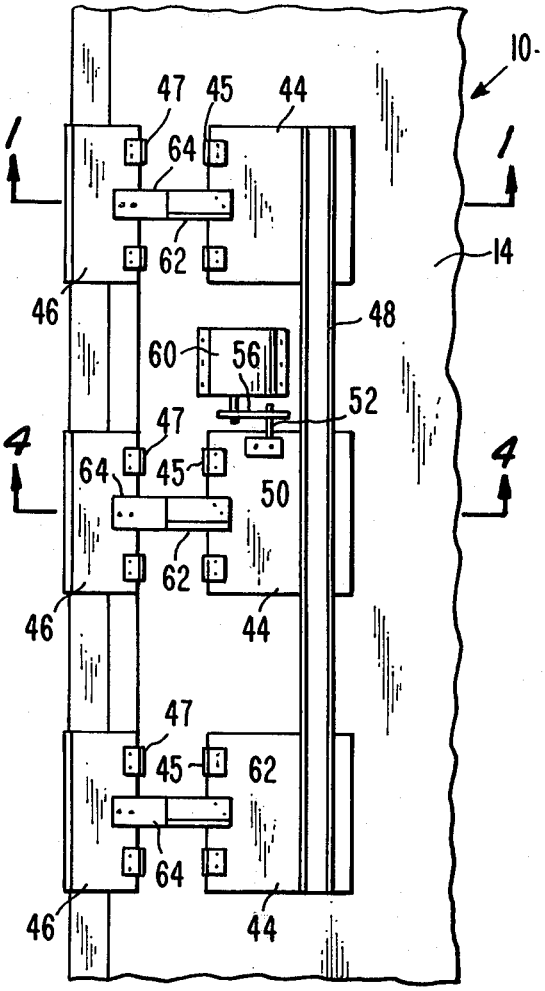
FIG. 2 is a fragmentary top plan view of the case of FIG. 1, as seen from line 2—2 of FIG. 1, the dampers being in closed position.

Referring to FIGS. 1 and 2, a case generally designated 10 is constructed similarly to that shown in the above-mentioned, contemporaneously filed application, including insulated rear, top, bottom and front walls 12, 14, 16, 18 respectively. An access opening 20 in the front wall 18 is normally closed by a door 22. The case includes a product display space 24 having shelves 26, a primary air duct or passage 28 extending between rear wall 12 and display space 24, an evaporator coil 30 in a lower plenum 31 of passage 28, and a primary air circulating fan 32 in the plenum, the fan being of the non-reversible type so that both refrigerated air (shown in full lines in FIG. 1) and defrost air (shown in dotted lines in FIG. 3) flow in the same direction.

During a refrigeration cycle (see FIG. 1) operation of the fan 32 causes air to be continuously recirculated within the case about the product display space 24, in the direction of the arrows shown in FIG. 1. The refrigerated air, passing through the coil 30, is forced upwardly within the primary duct 28, from which it is directed through nozzles 33 to flow downwardly through the display space and along the inside of the door, returning to the plenum as shown for further refrigeration and recirculation.

The air defrost system in the disclosed case includes a defrost air supply passage 34 overlying the entire back of the case, and opening at its lower end into a defrost air supply conduit 36, which communicates continuously with plenum 31 through the provision of a defrost air supply port or opening 38.

Mounted upon the top of the case is a longitudinal series of spaced defrost fan housings 40. Each is in communication with the upper end of passage 28 through the provision of a defrost air outlet or exhaust opening 41. In each housing 40 there is a defrost fan, which operates only during the defrost cycle shown in FIGS. 3, 5, and 8. A damper 44 closes the upper end of each housing 40, and is spaced transversely of the case from a damper 46 controlling the inflow of defrost air from the ambient atmosphere into the passage 34.

Figure 3:
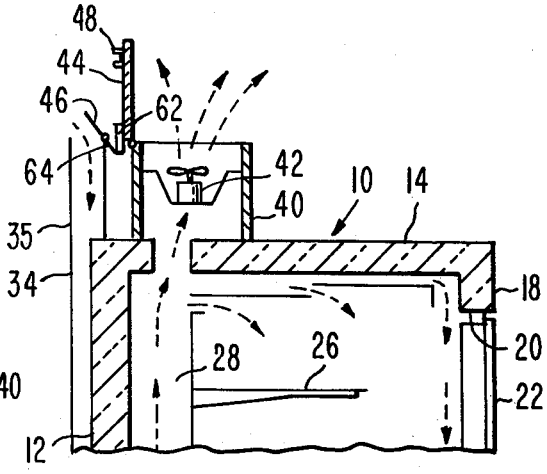
FIG. 3 is a fragmentary vertical sectional view through the upper portion of the case of FIG. 1, the dampers being illustrated in their open positions as required during a defrost cycle.

The disclosure of the above-mentioned contemporaneously filed application is incorporated herein by reference, and it is sufficient for the purposes of the present application only to note that during refrigeration the dampers 44, 46 are closed. During defrost, all the dampers 46 and 44 must be opened. Thus, during a defrost cycle, the several dampers 46 open simultaneously to admit air from the ambient atmosphere as shown in FIG. 3 by way of example. The air, passing downwardly within the passage 34, enters conduit 36, and thereafter is introduced into the plenum 31 through the opening 38. The defrost air is caused, by the continued operation of the primary fan 32, to pass through the coil 30, thereafter passing upwardly through duct 28 and being exhausted through the several openings 41 by reason of the combined operation of the fans 32 and 42. Mainly, a continuous fresh supply of ambient air passes through the coil 30. An inconsequential amount of said air, however, may be recirculated as shown by the dotted line arrows in FIG. 3, through the product display space for return to the plenum.

All the dampers 44 of the first or air exhaust damper series are pivoted about a common hinge axis 45 for movement between open and closed positions. Though three dampers are shown in said series in the illustrated example, the number may be substantially greater, according to the length of the case desired by the customer.

Similarly, the several dampers 46 of the second or air inflow series are also hinged about a common axis 47 parallel to the axis 45. At this point it may be observed that the defrost passage 34, at selected intervals longitudinally of the case, has upwardly projecting flue extensions 35, on which the dampers 46 are mounted. This disposes the dampers 46 at an elevation substantially coplanar with that of the dampers 44, to facilitate the joint opening and closing thereof.

In accordance with the invention, an elongated, channeled connecting bar 48 is fixedly secured to all the dampers 44 of the first series, so that they will operate between open and closed positions simultaneously. A selected one of the dampers 44, preferably located midway between opposite ends of the series, has fixedly secured thereto an angular bracket 50 from which projects a pin 52 (see FIGS. 4 and 5) extending through an elongated slot 54 of a radial arm 56 secured to and rotatable with the shaft 58 extending from a gear reduction motor 60 of the reversible type, mounted upon a stand 61 secured to the top of the display case.

Each damper 44 has fixedly secured thereto a cam plate 62 projecting rearwardly therefrom above the hinge axis of the damper, and having a rounded nose adapted to cammingly bear against a tongue 64 fixedly secured to the corresponding damper 46 of the air inflow damper series.

Figure 5:
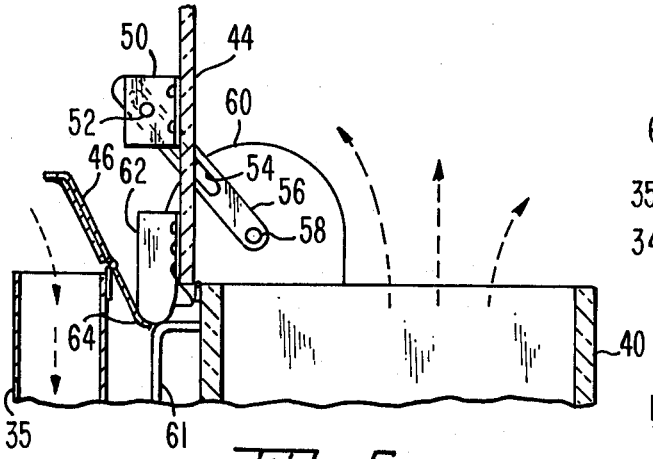
FIG. 5 is a view on the same scale and on the same cutting plane as FIG. 4, through the upper portion of the damper assembly illustrated in FIG. 4, with the dampers in the open position required for a defrost cycle.
Figure 4:
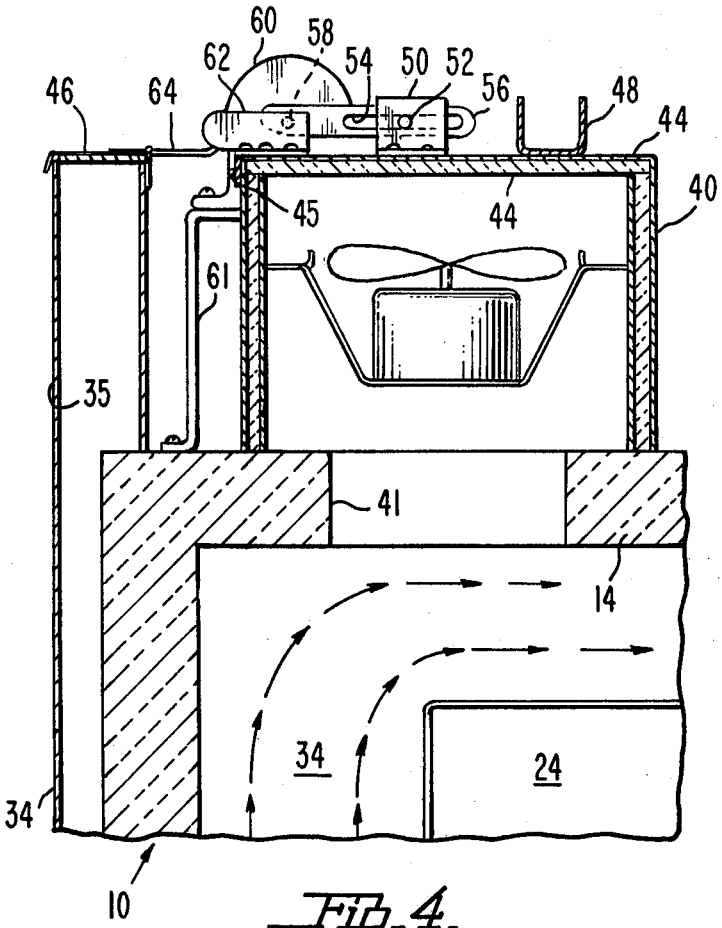
FIG. 4 is a greatly enlarged, fragmentary sectional view on the same cutting plane as FIG. 1, with the dampers in the closed position required during a refrigerating cycle.

As shown in FIGS. 4 and 5, when motor 60 goes into operation with the dampers of both series in closed position, arm 56, rotating counterclockwise as viewed in FIGS. 4 and 5, causes elevation of the adjacent damper 44 to open position as shown in FIG. 5. Through the provision of the connecting bar 48, all the other dampers 44 are simultaneously moved to open positions. At the same time, cam 62 bears downwardly upon tongue 64, so that the several dampers 46 are also simultaneously biased to their open positions.

This occurs during the initiation of each defrost cycle, so that air is now free to be drawn from the ambient into the defrost air supply passage 34, and be returned to ambient through the several exhaust openings 41.

When the dampers 44 are to be closed, motor 60 is operated in reverse to return its associated damper to closed position, resulting in the simultaneous closing of all the dampers 44. The several dampers 46 are now free to gravitate to their closed positions. Alternatively, each damper 46 may have a spring hinge to assure positive bias thereof to closed positions with minimum delay, thus to permit resumption of a refrigerating cycle.

Figure 7:
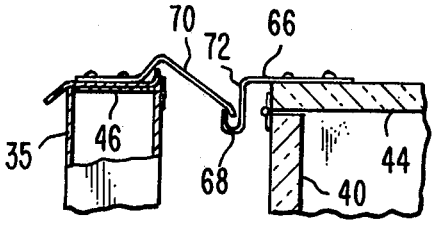
FIGS. 7 and 8 are views similar to FIG. 5, showing a modified construction, the dampers being in closed and opened positions respectively.
Figure 8:
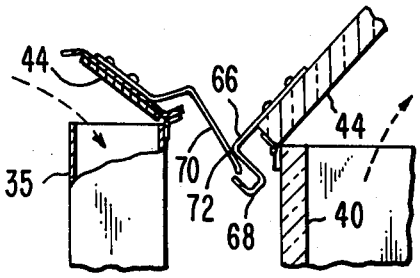
Figure 6:
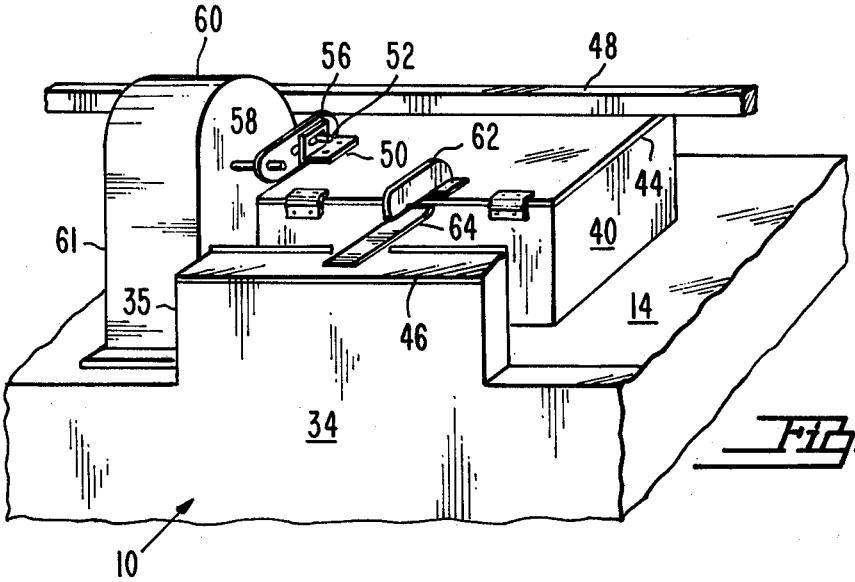
FIG. 6 is a fragmentary perspective view of the upper portion of a case showing one of the paired inflow and exhaust damper structures in association with the motor used for actuating the same between open and closed positions.

In FIGS. 7 and 8, there is illustrated a modified arrangement, in which the cam means on each damper 44 has a positive interrelationship or interengagement with the associated tongue of the adjacent, paired inflow damper 46. This results in a positive return of each damper 46 to a closed position when the associated damper 44 is closed.

To this end, each damper 44 includes a cam plate 66 which in this instance has a depending, J-shaped hook element 68 defining a recess receiving the distal end of tongue 70 of the associated, paired damper 46. When dampers 44 open, cam noses 72 thereof, defined at the location where hook elements 68 are bent downwardly, are adapted to bear against tongues 70 in the manner shown in FIG. 8. This biases the dampers 46 to open position. At the same time, the distal ends of tongues 70 are retained in the recesses defined by the J-shaped hook elements 68. As a result, when the dampers 44 move to closed positions, there is a controlled closing of the dampers 46, by reason of the fact that tongues 70 thereof are captive within the recesses of the J-shaped elements 68 and are retained in engagement with the noses 72 until dampers 44 move fully to their closed positions.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

What is claimed is:

1. In a refrigerated display case formed with an air inflow duct and an adjacent primary air passage having a refrigeration coil therein and respectively having inflow and exhaust openings for communicating said duct and passage with the ambient atmosphere during a defrost cycle, the improvement comprising:

(a) a first series of dampers controlling air flow through the exhaust openings;

(b) a second series of dampers controlling air flow through the inflow openings; and (c) means interengaging all of said dampers for joint simultaneous movement to open and closed positions respectively, the dampers of each series being arranged in a straight row, the row of dampers of the first series being parallel to the row of dampers of the second series, each damper of the first series being aligned transversely of said rows with a damper of the second series, the damper-interengaging means including an element extending between and rigidly connecting all the dampers of one of said series, said element being in the form of an elongated bar fixedly connected to each of the dampers of said one series and extending from end-to-end of said one series, the dampers of each series being hingedly mounted for movement between open and closed positions, all the dampers of each series being swingable about a common hinge axis, the hinge axes of the first and second series being parallel, said bar extending in parallel relation to said hinge axes, said damper-interengaging means including a cam on each damper of said one series and a tongue on the corresponding, transversely aligned damper of the other series engageable by the cam upon opening of the damper of said one series, the cams on the several dampers of said one series biasing the tongues of the several dampers of the other series when the dampers of said one series are moved to open position, for simultaneous movement of the dampers of the other series to open position conjointly with the dampers of said one series.

2. In a display case the improvement of claim 1 further including a single motor adjacent a damper of said one series, and means extending between said motor and said adjacent damper, adapted to swing the damper to an open position responsive to energizing of the motor.

3. In a display case the improvement of claim 2 wherein the means extending between the motor and said adjacent damper includes a shaft on the motor, an arm extending radially from and rotatable with said shaft and having a longitudinal slot, and a pin carried by the adjacent damper and extending into the slot to provide a sliding pivotal connection between said adjacent damper and the arm.

4. In a display case the improvement of claim 1 wherein said cam is formed with a rounded nose bearing against and overlying said tongue, said nose shifting upwardly responsive to closing of the damper on which it is mounted.

5. In a display case the improvement of claim 4 wherein the upward shifting of the nose of each cam frees the tongue underlying the same for gravitational closing of the damper on which the tongue is mounted.

6. In a display case the improvement of claim 1 wherein each cam is bent at right angles and includes a distal end bent approximately to a J-shape and receiving the distal end of the tongue engageable by said cam.

7. In a display case the improvement of claim 6 wherein the distal end of each tongue is retained within the J-shaped distal end of its associated cam during movement of the several dampers to closed position, whereby all the dampers of both series are interconnected during movement thereof both from closed to open and from open to closed positions.

8. In a refrigerated display case formed with an air inflow duct and an adjacent primary air passage having a refrigeration coil therein and respectively having inflow and exhaust openings for communicating said duct and passage with the ambient atmosphere during a defrost cycle, the improvement comprising:

(a) a first series of dampers controlling air flow through the exhaust openings;

(b) a second series of dampers controlling air flow through the inflow openings;

(c) means mechanically interengaging all of the dampers of at least one series for joint simultaneous movement to open and closed positions respectively;

(d) means mechanically interengaging the first and the second series for simultaneous joint movement of the dampers of both series to open and closed positions respectively; and (e) a single motor drivingly, mechanically engaged with at least one damper of one series for moving the engaged damper to each of its two positions and thereby effect a simultaneous movement of all of the remaining dampers of both series to a corresponding position.

9. In a display case the improvement of claim 8 wherein the means mechanically interengaging the first with the second series includes elements extending therebetween having a camming engagement with each other, when the motor is operated, effective to bias all the dampers of each series to the position to which the several dampers of the other series are moved.

10. In a refrigerated display case formed with an air inflow duct and an adjacent primary air passage having a refrigeration coil therein and respectively having inflow and exhaust openings for communicating said duct and passage with the ambient atmosphere during a defrost cycle, the improvement comprising:

(a) a first series of dampers controlling air flow through the exhaust openings;

(b) a second series of dampers controlling air flow through the inflow openings; and (c) means interengaging all of said dampers for joint simultaneous movement to open and closed positions respectively, the dampers of each series being arranged in a row parallel to the row of dampers of the other series, the damper-interengaging means including means extending between and connecting for joint movement all the dampers of at least one of said series, the dampers of each series being hingedly mounted for movement between open and closed positions, and said damper-interengaging means including a cam on one series and a tongue on the other series, biased by the cam upon opening of the dampers of said one series in a direction to open the several dampers of the other series when the dampers of said one series are moved to open position.

* * * * *